US010473008B2

(12) United States Patent
Zhang et al.

(10) Patent No.: US 10,473,008 B2
(45) Date of Patent: Nov. 12, 2019

(54) LUBRICANT HEALTH DETECTION SYSTEM

(71) Applicant: Caterpillar Inc., Peoria, IL (US)

(72) Inventors: Yanchai Zhang, Dunlap, IL (US); Venkata Dandibhotla, Peoria, IL (US); Kyle Brent Walton, Edelstein, IL (US); John J. Krone, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 131 days.

(21) Appl. No.: 15/853,113

(22) Filed: Dec. 22, 2017

(65) Prior Publication Data

US 2019/0195097 A1 Jun. 27, 2019

(51) Int. Cl.

| | |
|---|---|
| ***F01M 11/10*** | (2006.01) |
| ***E02F 9/26*** | (2006.01) |
| *E02F 3/34* | (2006.01) |

(52) U.S. Cl.

CPC ..... *F01M 11/10* (2013.01); *E02F 9/267* (2013.01); *E02F 3/34* (2013.01); *F01M 2011/148* (2013.01); *F01M 2011/1473* (2013.01); *F01M 2250/60* (2013.01); *F01M 2250/62* (2013.01)

(58) Field of Classification Search

CPC ..... F01M 11/10; F01M 2011/148; F01M 2250/60; F01M 2250/62; F01M 2011/1473; E02F 9/267; E02F 3/34

USPC ..... 701/29.5

See application file for complete search history.

(56) References Cited

U.S. PATENT DOCUMENTS

| | | | | |
|---|---|---|---|---|
| 5,604,441 | A * | 2/1997 | Freese, V | G01N 27/221 324/663 |
| 5,889,200 | A * | 3/1999 | Centers | G01N 27/06 324/693 |
| 5,933,016 | A * | 8/1999 | Kauffman | G01N 27/06 324/446 |
| 5,964,318 | A | 10/1999 | Boyle et al. | |
| 6,028,433 | A * | 2/2000 | Cheiky-Zelina | G01N 33/2888 324/663 |
| 6,196,057 | B1 | 3/2001 | Discenzo | |
| 6,217,745 | B1 * | 4/2001 | Fang | G01N 33/2835 204/400 |
| 6,268,737 | B1 * | 7/2001 | Marszalek | G01N 27/221 324/658 |

(Continued)

FOREIGN PATENT DOCUMENTS

| | | |
|---|---|---|
| WO | 2017044821 | 3/2017 |
| WO | 2017044821 A1 | 3/2017 |
| WO | 2017062273 | 4/2017 |

*Primary Examiner* — Muhammad Shafi

(74) *Attorney, Agent, or Firm* — Miller, Matthias & Hull

(57) ABSTRACT

A system and method for activating on a user interface an indicator of a condition of a lubricant in a machine module. The system may comprise a controller and a user interface. The controller may be configured to, for each of a first time window and a second time window: receive a plurality of lubricant characteristics and measured lubricant temperatures, calculate an adjusted lubricant characteristic, and determine a slope based on the plurality of adjusted lubricant characteristics. The controller may further determine a change in slope, and generate a signal to activate the indicator on the user interface based on the change in slope, wherein, if the change in slope exceeds a threshold, the indicator is a lubricant changed indicator.

20 Claims, 4 Drawing Sheets

(56) References Cited

U.S. PATENT DOCUMENTS

| | | | | |
|---|---|---|---|---|
| 6,278,281 | B1 * | 8/2001 | Bauer | G01N 27/221<br>324/441 |
| 6,535,001 | B1 * | 3/2003 | Wang | F01M 11/12<br>123/196 R |
| 6,644,095 | B2 * | 11/2003 | Van Mullekom | F01M 11/04<br>73/10 |
| 7,581,434 | B1 * | 9/2009 | Discenzo | G01N 33/2888<br>73/53.01 |
| 7,900,507 | B2 * | 3/2011 | Kauffman | G01M 15/042<br>73/114.55 |
| 2005/0039521 | A1 | 2/2005 | Han et al. | |

* cited by examiner

LUBRICANT HEALTH DETECTION SYSTEM

TECHNICAL FIELD

The present disclosure generally relates to control processes for controlling automatic real-time detection of lubricant health in a machine.

BACKGROUND

When the lubricant (e.g., oil) is changed on a machine, a switch or a timer is typically manually set. If the operator or maintenance technician forgets to set the timer or switch, or sets such at a later date, the hours since the last lubricant change will be inaccurate and may result in the machine being run using lubricant that is outside the range of recommended useful life. Such may contribute to hardware failure or damage of componentry of the machine by cavitation, corrosion and/or the like.

U.S. Pat. No. 5,604,441 discloses a method and apparatus for detecting the degree of deterioration of a lubricating oil based on a dielectric medium. The apparatus includes a monitoring means for monitoring the capacitance of a sensor to determine the condition of the oil based on a change in sensor capacitance.

SUMMARY OF THE DISCLOSURE

In accordance with an aspect of the disclosure, a system for activating on a user interface an indicator of a condition in a lubricant in a module of a machine is disclosed. The system comprises a controller and a user interface. The controller may be configured to for a first time window and a second time window: receive a plurality of lubricant characteristics and measured lubricant temperatures of the lubricant in the module, each of the plurality of lubricant characteristics being associated with a respective measured lubricant temperature of the measured lubricant temperatures; calculate an adjusted lubricant characteristic for each of the plurality of lubricant characteristics based on the lubricant characteristic and a relationship between a standard temperature and the respective measured lubricant temperature that is associated with the lubricant characteristic; and determine, for one or more types of the plurality of lubricant characteristics received, a slope in each of the first time window and the second time window, the slope being based on a plurality of adjusted lubricant characteristics of the same type. The controller may be further configured to determine a change in the slope from the first time window to the second time window of adjusted lubricant characteristics of the same type; and generate a signal to activate the indicator on the user interface based on the change in slope. The user interface is configured to display the indicator based on the signal generated by the controller, wherein if the change in slope for the plurality of adjusted lubricant characteristics exceeds a threshold, the indicator is a lubricant changed indicator.

In accordance with another aspect of the disclosure, a method for activating on a user interface an indicator of a condition that is a measure of quality of a lubricant in a module of a machine is disclosed. The method may comprise receiving, for a first time window and a second time window, a plurality of lubricant characteristics and measured lubricant temperatures of the lubricant in the module, each of the plurality of lubricant characteristics being associated with a respective measured lubricant temperature of the measured lubricant temperatures; calculating an adjusted lubricant characteristic for each of the plurality of lubricant characteristics based on the lubricant characteristic and a relationship between a standard temperature and the respective measured lubricant temperature that is associated with the lubricant characteristic; determining, for one or more types of the plurality of lubricant characteristics received, a slope in each of the first time window and the second time window, the slope being based on a plurality of adjusted lubricant characteristics of the same type; determining a change in the slope from the first time window to the second time window of adjusted lubricant characteristics of the same type; generating, by a controller, a signal to activate the indicator on a user interface based on the change in slope; and displaying the indicator of the condition of the lubricant in the module on the user interface based on the signal generated by the controller, wherein if the change in slope for the plurality of adjusted lubricant characteristics exceeds a threshold, the indicator is a lubricant changed indicator.

In accordance with a further aspect of the disclosure, a system for automatically detecting when a lubricant has been changed in a module of a machine and activating an indicator of the condition of the lubricant in the module of the machine is disclosed. The system may comprise a controller and a user interface. The controller may be configured to, for each of a first time window and a second time window: receive a plurality of lubricant characteristics, measured lubricant temperatures, and current operating parameters of the module, each of the plurality of lubricant characteristics being associated with a respective measured lubricant temperature of the plurality of measured lubricant temperatures and a respective current operating parameter of the plurality of current operating parameters of the module; for each lubricant characteristic, if the measured lubricant temperature associated with the lubricant characteristic is in a desired temperature range and the current operating parameter associated with the lubricant characteristic is in a desired parameter range, calculate an adjusted lubricant characteristic based on the lubricant characteristic and a relationship between a standard temperature and the respective measured lubricant temperature associated with the lubricant characteristic; and determine, for one or more types of the plurality of lubricant characteristics received, a slope in each of the first time window and the second time window, the slope being based on a plurality of adjusted lubricant characteristics of the same type. The controller may be further configured to determine a change in the slope from the first time window to the second time window of adjusted lubricant characteristics of the same type; and generate a signal to activate the indicator on the user interface based on the change in slope. The user interface may be configured to display the indicator of the condition of the lubricant in the module based on the signal generated by the controller, wherein if the change in slope from the first to second time windows for the plurality of adjusted lubricant characteristics exceeds a threshold, the indicator is a lubricant changed indicator.

DETAILED DESCRIPTION

Figure 1:
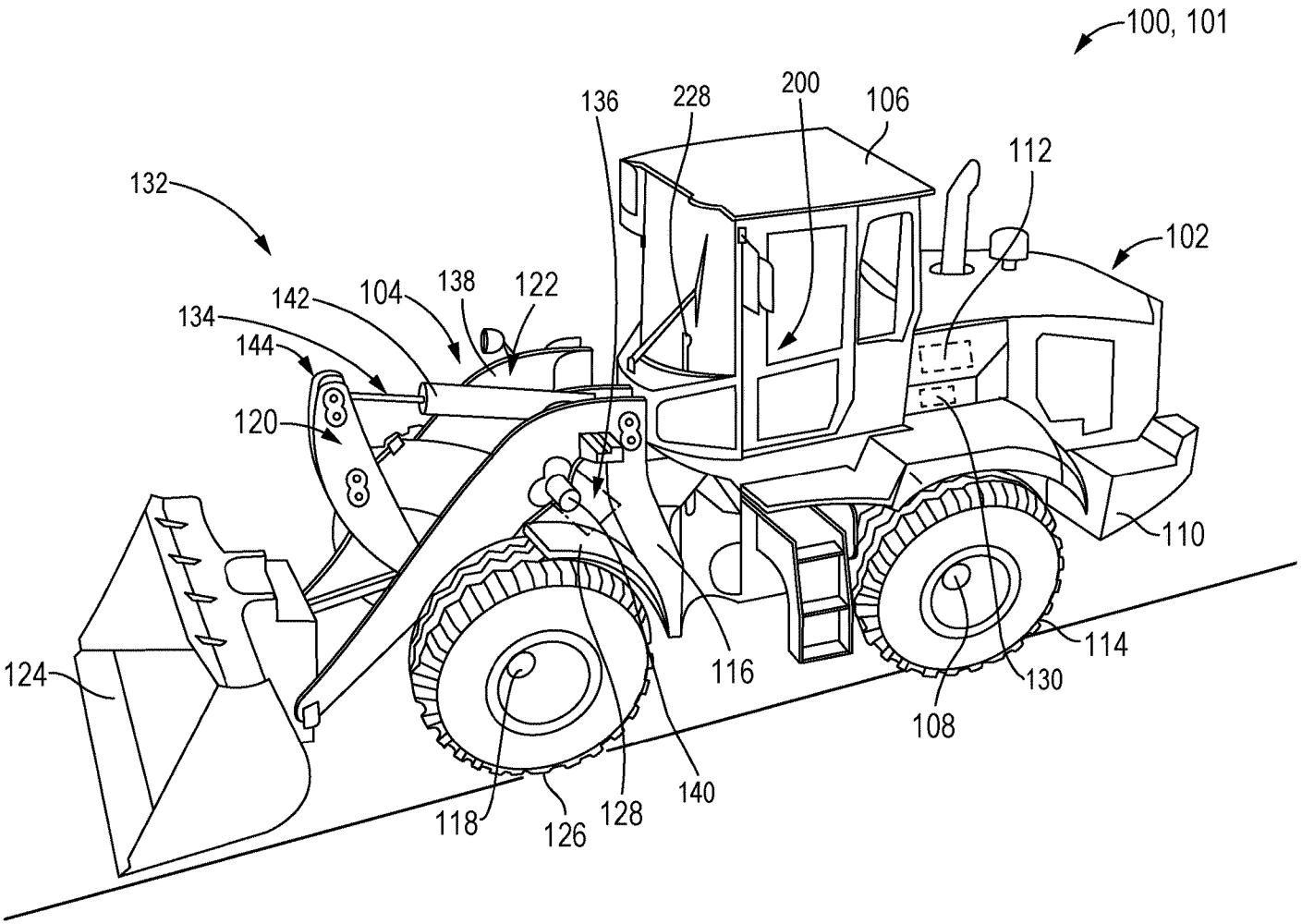
FIG. 1 is a side view of an exemplary machine 100 that includes the features disclosed herein.

FIG. 1 illustrates one example of a machine 100 that incorporates the features of the present disclosure. The exemplary machine 100 may be a vehicle such as wheel loader 101 illustrated in FIG. 1, although features disclosed herein may be utilized with other types of machines. The term "machine" includes vehicles or machines. The wheel loader 101 illustrated in FIG. 1 includes a rear portion 102 and a front portion 104. The rear portion 102 may include a cab assembly 106, and a rear axle assembly 108 mounted to a rear frame 110. The engine 112 may be mounted to the rear frame 110. The rear wheels 114 may be mounted to the rear axle assembly 108. The front portion 104 may include a frame assembly 116 and a front axle assembly 118. A lever assembly 120 and a lift arm assembly 122 may be pivotably coupled to the frame assembly 116. An implement 124, for example a bucket, may be connected to the lever assembly 120 and to the lift arm assembly 122. The front wheels 126 may be mounted on the front axle assembly 118 which may be mounted on the frame assembly 116. A fender 128 may also be mounted on the frame assembly 116. The machine 100 further includes a transmission 130 operably connected to the engine 112 and at least one of the rear axle assembly 108 and front axle assembly 118. The engine 112 is configured to provide power to the transmission 130. The engine 112 may be any type of engine (internal combustion, gas, diesel, gaseous fuel, natural gas, propane, etc.), and may be of any size, with any number of cylinders, and in any configuration ("V," in-line, radial, etc.).

The machine may further include a hydraulic system 132. The hydraulic system 132 may include an implement hydraulic system 134, and a pump 135 (see FIG. 2) configured to supply fluid under pressure to the implement hydraulic system 134. The implement hydraulic system 134 may include a pivot actuator 142. In the exemplary embodiment, the hydraulic system 132 may also include a lift arm hydraulic system 136, and the pump 135 may also be configured to supply fluid to the lift arm hydraulic system 136. The pump 135 may include one or more pumps.

The lift arm hydraulic system 136 may include one or more lift arm actuators 140. The lift arm assembly 122 may include a pair of lift arms 138 operably coupled to the one or more lift arm actuators 140. The lift arms 138 may be pivotally connected to the frame assembly 116. The lift arm actuator(s) 140 may extend between the frame assembly 116 and the lift arms 138. In an embodiment, the lift arm actuator 140 may be a rod and cylinder arrangement, as is known in the art. Fluid supplied by the pump 135 to the lift arm hydraulic system 136 may be used to provide pressurized fluid to the lift arm actuator 140 to raise and lower the lift arms 138.

The lever assembly 120 may include linkage 144 operably coupled to the pivot actuator 142 and may be disposed between the pivot actuator 142 and the implement 124 (e.g., the bucket). The implement 124 may be pivotally connected to an end of the linkage 144 and to the lift arms 138. The pivot actuator 142 may be disposed between the linkage 144 and the frame assembly 116. In an embodiment, the pivot actuator 142 may be a rod and cylinder arrangement. Fluid supplied by the pump 135 to the implement hydraulic system 134 may be used to provide pressurized fluid to the pivot actuator 142 to pivot or tilt the implement 124 about a pivot point.

Figure 2:
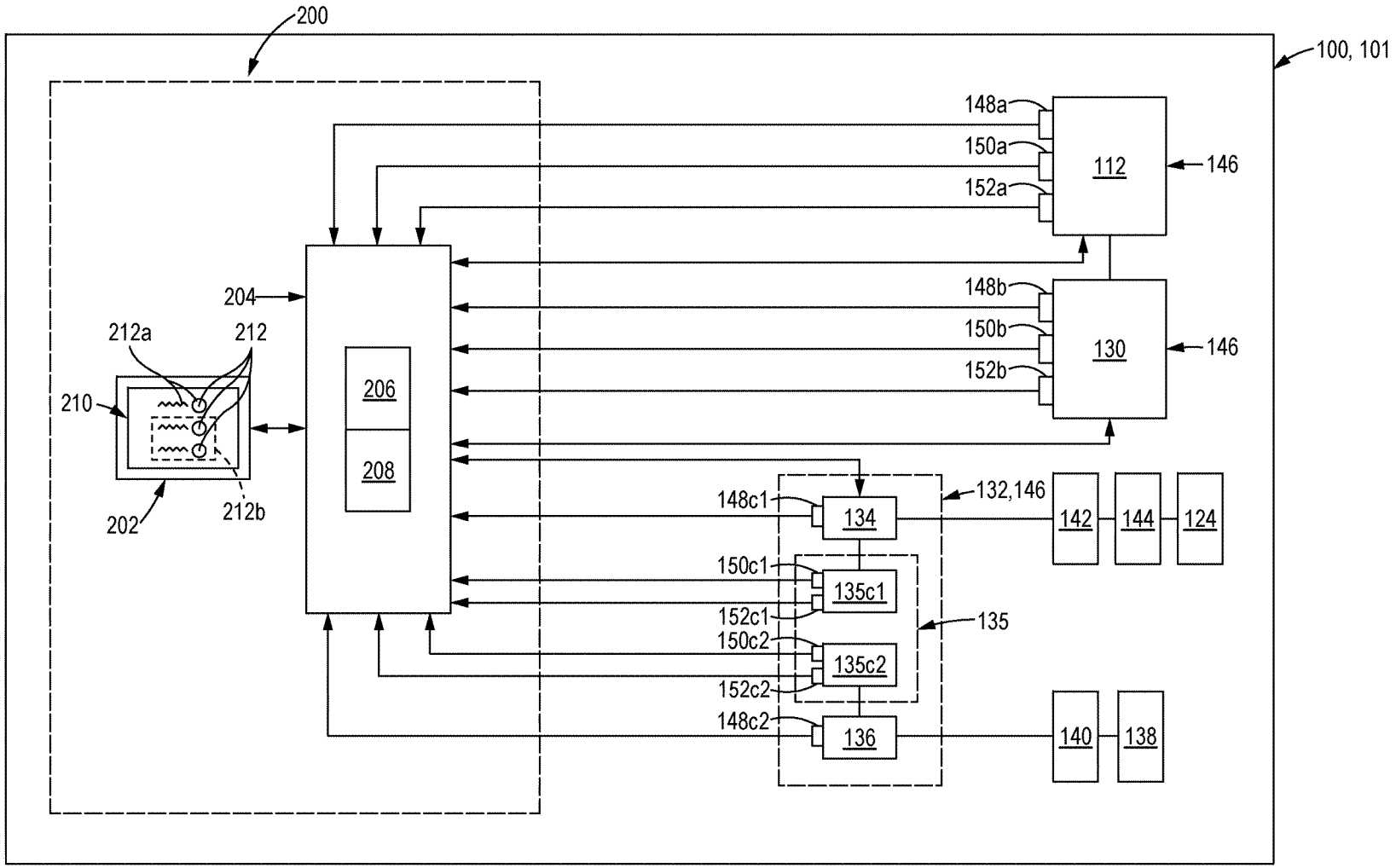
FIG. 2 is a schematic representation of an exemplary system 200 disclosed herein.

FIG. 2 is a schematic illustration of an exemplary system 200 for activating on a user interface 202 an indicator 212 of a condition of a lubricant in a module 146 of the machine 100. The module 146 of the machine 100 may be, or may include, the engine 112, the transmission 130, the hydraulic system 132 or a portion of the hydraulic system 132 (e.g., in the example of FIG. 1, a portion of the hydraulic system 132 may be the implement hydraulic system 134 or the lift arm hydraulic system 136). All or a portion of the system 200 may be disposed on-board the machine 100 or remote from the machine 100.

The system 200 includes the user interface 202 and a controller 204 in operable communication with the user interface 202. The controller 204 is in operable communication with the engine 112, the transmission 130 and/or the hydraulic system 132 (or portions of the hydraulic system 132, e.g., in the exemplary machine 100 of FIG. 1, the implement hydraulic system 134 or the lift arm hydraulic system 136.)

The controller 204 is configured to receive from a lubricant sensor 148 a measured lubricant temperature and one or more lubricant characteristics 402 for a lubricant in a module 146. The lubricant characteristics 402 may include viscosity or density of the lubricant in the module 146. The controller 204 may be further configured to generate a signal to activate an indicator 212 on the user interface 202.

The controller 204 may include a processor 206 and a memory component 208. The processor 206 may be a microprocessor or other processor as known in the art. The processor 206 may execute instructions and generate control signals for processing the measured lubricant temperature and the lubricant characteristic 402 to determine, for each measurement, point an adjusted lubricant characteristic that corresponds to the lubricant characteristic 402 received. The processor 206 may execute instructions and generate control signals for determining a slope 406 (see FIG. 4) for the time window 404 based on a plurality of the adjusted lubricant characteristics in the time window 404 and for determining a change in slope 424 between time windows 404 (for which a slope 406 has been calculated). The controller 204 is configured to generate a signal that results in activation on the display 210 of the user interface 202 of an indicator 212 of the condition of the lubricant in the module 146. When the change in slope 424 (of adjusted lubricant characteristics of the same type) exceeds a threshold 422, the indicator 212 of the condition of the lubricant in the module 146 may be a lubricant changed indicator 212*a*. Such instructions that are capable of being executed by a computer may be read into or embodied on a computer readable medium, such as the memory component 208 or provided external to the processor 206. In alternative embodiments, hard wired circuitry may be used in place of, or in combination with, software instructions to implement a control method.

The term "computer readable medium" as used herein refers to any non-transitory medium or combination of media that participates in providing instructions to the processor 206 for execution. Such a medium may comprise all computer readable media except for a transitory, propagating signal. Forms of computer-readable media include, for example, any magnetic medium, a CD-ROM, any optical medium, or any other medium from which a computer processor 206 can read.

The user interface 202 is in operable communication with the controller 204. The user interface 202 may include a display 210 and is configured to receive user input and to display on the display 210 output received from the controller 204. For example, the user interface 202 may be a graphical user interface. The output includes the indicator 212 of the condition of the lubricant in the module 146 based on the signal generated by the controller 204.

A lubricant sensor 148 (a, b, c1, c2) may be disposed on a module 146 of the machine 100. The lubricant sensor 148 is configured to measure the temperature and one or more characteristics of the lubricant in the module 146 at a measurement point (in time) and to provide to the controller 204 the measured lubricant temperature, and the (measured) one or more lubricant characteristics 402. A plurality of such measurements may be taken during a given time window 404. Any appropriate sensor known in the art that is suitable for this purpose may be utilized. The lubricant sensor 148 measures, at a plurality of measurement points (in time), and to provides to the controller 204 the measured lubricant temperature of the lubricant in the module 146, and one or more lubricant characteristics 402.

One or more speed sensors 150 (a, b, c1, c2) may be disposed on the machine to measure the speed of the module 146 at a measurement point (in time) and provide the measured speed to the controller 204. For example, in the exemplary wheel loader 101, the speed sensor 150*a* may measure at a plurality of measurement points (in time) the revolutions per minute (rpm) of the engine 112 and provide that information to the controller 204. Likewise, the speed sensor 150*b* may be disposed on the machine 100 to measure at a plurality of measurement points (in time) the speed of the transmission 130 and provide that information to the controller 204.

One or more load sensors 152 (a, b, c1, c2) may be disposed on the machine 100 to measure at a measurement point (in time) the load of the module 146 and provide the measured load to the controller 204. For example, in the exemplary wheel loader 101, the load sensor 152*a* may measure at a plurality of measurement points (in time) the engine load and provide that information to the controller 204. Likewise, the load sensor 152*b* may be disposed on the machine 100 to measure at a plurality of measurement points (in time) the transmission load and provide that information to the controller 204. Similarly, the load sensor 152 may be disposed on the machine 100 to measure at a plurality of measurement points (in time) the load on the hydraulic system 132. For example, a load sensor 152*c*1 may be disposed on the machine 100 to measure at a plurality of measurement points (in time) the load on the implement hydraulic system 134 and provide that information to the controller 204. Similarly, a load sensor 152*c*2 may be disposed on the machine 100 to measure at a plurality of measurement points (in time) the load on the lift arm hydraulic system 136 and provide that information to the controller 204.

INDUSTRIAL APPLICABILITY

Figure 3:
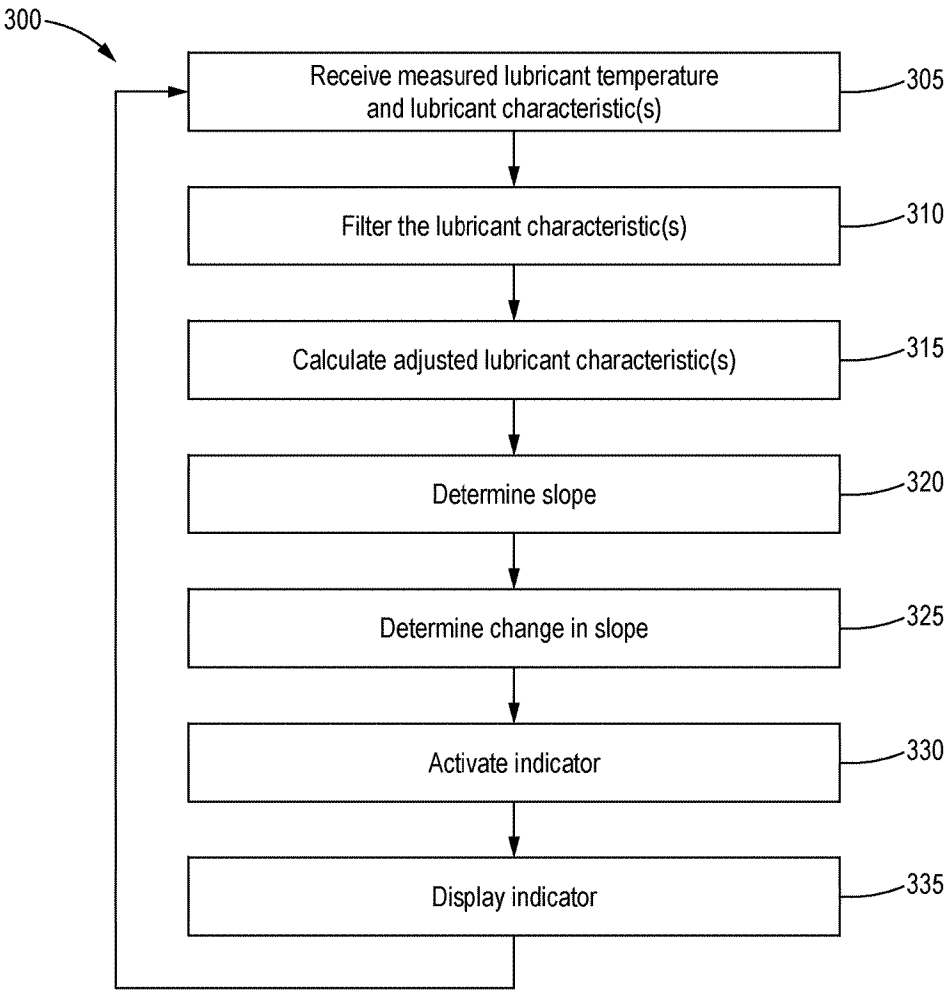
FIG. 3 is an exemplary process for automatically detecting, in real time, a condition (or health) of a lubricant in a module 146 of a machine 100 and activating, on a user interface 202, an indicator 212 of the condition of the lubricant.

FIG. 3 illustrates one exemplary method 300 for automatically detecting, in real time, a condition (or health) of a lubricant in a module 146 of a machine 100 and activating, on a user interface 202, an indicator 212 of the condition of the lubricant in a module 146 of a machine 100. The method 300 may be practiced with more or less than the number of blocks shown and is not limited to the order shown. In some embodiments, the lubricant may be oil.

In block 305, the controller 204 receives at a measurement point (in time) from a lubricant sensor 148 (a, b, c1, c2) for a module 146 of the machine 100 a measured lubricant temperature and one or more lubricant characteristics 402 of the lubricant in the module 146. The lubricant characteristic(s) 402 received by the controller 204 in block 305 may be viscosity and/or density (of the lubricant in the module 146) that have been measured by the lubricant sensor 148 (a, b, c1, c2). The controller 204 may also receive from the lubricant sensor 148 (a, b, c1, c2) one or more failure mode indicators that indicate an error condition in the lubricant sensor 148 (a, b, c1, c2). Such error conditions may include, for example, a voltage error, open circuit error, out-of-range error or the like. If such an error conditions is received by the controller 204 from the lubricant sensor 148 (a, b, c1, c2), the measured lubricant temperature and lubricant characteristic 402 (received from the lubricant sensor 148 (a, b, c1, c2) for the same measurement point in time) are not utilized by the controller 204 for further calculations to determine the condition of the lubricant in the module 146.

In block 310, the controller 204 may filter the lubricant characteristic(s) 402 received in block 305. The filtering may be conditional filtering and/or noise filtering. For conditional filtering, the controller 204 may filter the lubricant characteristic(s) 402 based on the measured lubricant temperature. If the controller 204 determines that the measured lubricant temperature is not in a desired temperature range for the module 146, the lubricant characteristic(s) 402 (for that measurement point) is/are not utilized by the controller 204 for further calculations to determine the condition of a lubricant in the module 146.

Alternatively, or in addition to filtering based on the measured lubricant temperature, during conditional filtering, the controller 204 may filter the lubricant characteristic(s) 402 based on one or more current operating parameters of the module 146. When the module 146 is an engine 112, the current operating parameters may include engine speed and/or engine load. The engine speed may be received by the controller 204 from the speed sensor 150*a* for the engine 112. The engine load may be received by the controller 204 from the load sensor 152*a* for the engine 112.

When the module 146 is a transmission 130, the current operating parameters may include transmission speed and/or transmission load. The transmission speed may be received by the controller 204 from the speed sensor 150*b* for the transmission 130. The transmission load may be received by the controller 204 from the load sensor 152*b* for the transmission 130.

When the module 146 is a hydraulic system 132 (or portion of a hydraulic system 132, e.g., the implement hydraulic system 134, the lift arm hydraulic system 136 or the like), the current operating parameters may include the speed of the pump 135 supplying fluid to the respective hydraulic system 132 (or 134 or 136) and/or the load on the pump 135 supplying fluid to the respective hydraulic system 132 (or 134 or 136). The speed of the pump 135 supplying fluid to the respective hydraulic system 132 (or 134 or 136) may be received by the controller 204 from the speed sensor 150(c1, c2) for such pump 135. The load on the pump 135 supplying fluid to the respective hydraulic system 132 (or 134 or 136) may be received by the controller 204 from the load sensor 152(c1, c2) for the for the pump 135.

The controller 204 compares each of the current operating parameters for each module 146 to a desired parameter range for each such respective operating parameter for the module 146. For example, if the current operating parameter is operating speed of the module 146, the controller 204 will compare the current (actual) operating speed (current operating parameter) to a desired speed range (desired parameter range) for that module 146. If the current operating parameter is load on the module 146, the controller 204 will compare the current (actual) load on the module 146 (current operating parameter) to a desired load range (desired parameter range) for that module 146. In some embodiments, the desired parameter range may be associated with an operating mode of the machine 100 (e.g., digging, loading, lifting, dumping, hauling, traveling (forward, reverse), or the like) or a power mode (e.g., high, standard or economy) for the machine 100. If one or more of the current operating parameters is not in the respective desired parameter range for that operating parameter, the lubricant characteristic(s) 402 (for that measurement point) for that module 146 is/are not utilized by the controller 204 for further calculations to determine the condition of the lubricant in the module 146.

For embodiments that include noise filtering, the controller 204 filters the lubricant characteristic(s) 402 to remove noise from the signal received by the controller 204 from the lubricant sensor 148 for the module 146. One or more low pass filters (or the like) may be utilized (by the controller 204) to remove noise from (the signal that contains) the lubricant characteristic(s) 402 received by the controller 204.

In block 315, for each lubricant characteristic 402, the controller 204 calculates an adjusted lubricant characteristic for the measurement point. The intention is to make comparable the values for lubricant characteristics 402 that may have been obtained at different measured lubricant temperatures by normalizing or compensating (such values of) the lubricant characteristic(s) 402) for the difference between the measured lubricant temperature at which such measurements were obtained and a standard temperature. In other words, each (measured) lubricant characteristic 402 is converted to the (estimated) value such lubricant characteristic 402 would be if the measurement had been obtained when the lubricant was at the standard temperature in the module 146. In one embodiment, each lubricant characteristic 402 (measurement) taken when the lubricant was at the measured lubricant temperature may be scaled to the adjusted lubricant characteristic at a standard temperature. This may be accomplished by multiplying the (value of the measured) lubricant characteristic 402 by the ratio of the standard (lubricant) temperature (for the module 146) to the measured lubricant temperature to obtain the adjusted lubricant characteristic. In an embodiment, the (value of the) lubricant characteristic 402 may be adjusted by a linear or non-linear equation function to calculate the adjusted lubricant characteristic. Other methodologies may be used to scale or convert each lubricant characteristic 402 to a comparable adjusted lubricant characteristic. If the lubricant characteristic 402 has been filtered to remove noise, the determination of the adjusted lubricant characteristic explained above utilizes the noise filtered (measured) lubricant characteristic 402 instead of an unfiltered (measured) lubricant characteristic 402.

Figure 4:
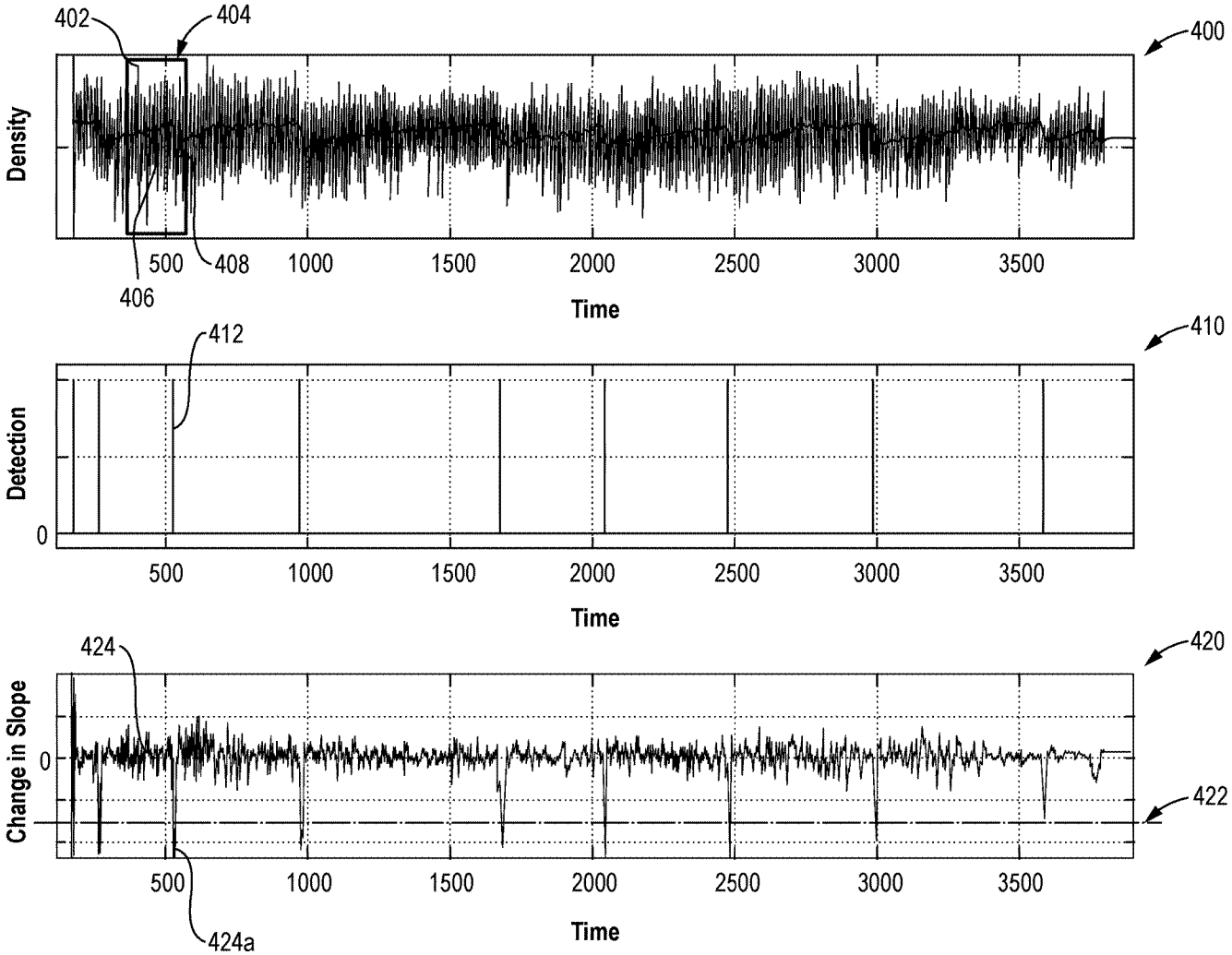
FIG. 4 illustrates exemplary related graphs 400, 410 and 420. Graph 400 shows the plotted lubricant characteristics 402 and the plotted slope 406 of the associated adjusted lubricant characteristics over time. The exemplary graph 420 illustrates the plotted change in slope 424 over time for the plotted slope 406 (of the adjusted lubricant characteristics) of graph 400. Graph 410 illustrates exemplary detection points over time associated with the change in slope 424 of graph 420 exceeding a threshold 422.

In block 320, for each lubricant characteristic 402 to be evaluated (viscosity or density), the controller 204 determines a slope 406 for a time window 404 (see FIG. 4, graph 400 for an exemplary time window 404). The time window 404 is comprised of a plurality of measurement points (in time). Associated with each measurement point is an adjusted lubricant characteristic (value) for each lubricant characteristic 402 (received) to be evaluated. The slope 406 for the time window 404 is determined based on the (calculated values of the) adjusted lubricant characteristics (of the same type, e.g., viscosity or density) for the plurality of measurement points in the time window 404. In some embodiments, the time window 404 is a rolling time window. The span of time covered by the time window 404 is referred to as its window length. In an embodiment in which the time window 404 is a rolling time window, as a new measurement point (in time) is added to the plurality of measurement points covered by the time window 404, the oldest measurement point in time is removed from (the window length of) the time window 404 if the addition of the new measurement point increases the total time span (period) covered by the time window 404 to longer than its predetermined window length. The slope 406 of the adjusted lubricant characteristics in a time window 404 may be determined by curve fitting (a plot of the values of the respective adjusted lubricant characteristic for the time window 404) or like methodologies known in the art for determining a slope 406 from a plurality of data points. For example, if the lubricant characteristic 402 to be evaluated is viscosity, the controller 204 may curve fit the data points of adjusted lubricant characteristics (for viscosity) in the time window 404.

In block 325 (FIG. 3), the controller 204 determines a change in slope 424 (of adjusted lubricant characteristics) (see FIG. 4 for an exemplary change in slope 424) between sequential time windows 404 for which a slope 406 has been calculated. For example, the controller 204 may determine a change between the slope 406 of the current time window 404 and the slope 406 of the preceding time window 404. The controller 204 further determines whether such change in slope 424 (between sequential time windows 404 for which a slope 406 has been calculated) exceeds a threshold 422.

Typically, as the lubricant in a module 146 degrades with time and use, the adjusted lubricant characteristic values for viscosity will increase gradually and the slope 406 (of the adjusted lubricant characteristic values for viscosity) in a given time window 404 for a module 146 will be flat or oriented in a gradual, upward direction. The change in slope 424 (of the adjusted lubricant characteristic values) from one time window 404 to the next time window 404 (for which a slope 406 has been calculated) will usually be in a predictable range. However, when the lubricant in the module 146 has degraded to a point that it has been changed, the viscosity (adjusted lubricant characteristic values of) will decrease rapidly over a relatively short period of time and the change in slope 424 (of the adjusted lubricant characteristic (values) for viscosity) from one time window 404 to the next time window 404 (for which a slope 406 has been calculated) will increase to the extent that the change in slope 424 exceeds a threshold 422 for the viscosity change in slope 424 (e.g., a viscosity threshold). Thus, the controller 204 determines that the lubricant in the module 146 was changed if the change in slope 424 (of the adjusted lubricant characteristic values) from one time window 404 to the next sequential time window 404 (for which a slope 406 has been calculated) exceeds a threshold 422 value associated with the change in slope 424 for the adjusted lubricant characteristic values for viscosity for that module 146.

As the lubricant in a module 146 degrades with time and use, the adjusted lubricant characteristic values for density will increase gradually and the slope 406 (of such adjusted lubricant characteristic values for density) in a given time window 404 will be gradual and oriented in an upward direction. While FIG. 4 has been utilized herein to facilitate the discussion herein at a more generalized level, the three related exemplary graphs in FIG. 4 are specifically directed to an exemplary lubricant characteristic 402 of density. Graph 400 illustrates a plot of the lubricant characteristics 402 of density at each measurement point in an exemplary time window 404. The slope 406 for the adjusted lubricant characteristics of density in the exemplary time window 404 may be seen on the graph 400 as well. When lubricant has been changed, the adjusted lubricant characteristic values for density decrease rapidly resulting in a downward spike 408 in the slope 406 of the adjusted lubricant characteristics for the density. This downward spike 408 is followed by the adjusted lubricant characteristic values for density increasing gradually and the slope 406 becoming oriented in a gradual upward direction, as can be seen in graph 400. In some embodiments, the downward spike 408 may be used by the controller 204 for automatically detecting when the oil has been changed. Graph 420 illustrates the change in slope 424 from one time window 404 to the next. The change in slope 424 (of the adjusted lubricant characteristic values for density) from one time window 404 to the next time window 404 (for which a slope 406 has been calculated) is usually in a predictable range. The controller 204 determines that the lubricant in the module 146 has been changed when the change in slope 424 (of the adjusted lubricant characteristic values) (see graph 420) exceeds a threshold value 422 associated with the change in slope 424 for the adjusted lubricant characteristic values for density (e.g., exceeds a density threshold) for that module 146. As can be seen the change in slope 424*a* plotted in graph 420 exceeds a threshold 422 (value) at, for example a little over the exemplary time of 500 time units. Graph 410 illustrates the associated detection by the controller 204 of when the lubricant has been changed (see reference number 412 on graph 410). This methodology is similar to that for viscosity.

In block 330, the controller 204 may generate a signal to activate an indicator 212 on the display 210 of the user interface 202 (of the condition of the lubricant in a module 146 of the machine 100) based at least in part on the result of block 325 for a module 146. The indicator 212 may be a lubricant changed indicator 212*a* or a normal status indicator 212*b*.

If the change in slope 424 is determined in block 325 to exceed a threshold 422 for the lubricant characteristic 402 for the module 146 and the lubricant characteristic 402 is viscosity or density, the controller 204 generates a signal to activate a lubricant changed indicator 212*a* (FIG. 2), on the user interface 202, associated with the lubricant in that module 146. The controller 204 may also: reset the remaining useful life for the lubricant to take into account the newly changed status (e.g., reset to 100% or the like remaining useful life) of the lubricant in the module 146; or reset a clock or hours-of-use meter for the lubricant in the module 146 to take into account the newly changed status of the lubricant in the module 146; or reset the calculation for estimating remaining useful life (of the lubricant) to take into account the newly changed status of the lubricant in the module 146.

In some embodiments, (but not necessarily all embodiments, if the change in slope 424 is determined in block 325 not to exceed a threshold 422 for the lubricant characteristic 402 for the module 146, the controller 204 may generate a signal to activate a normal status indicator 212*b*, on the user interface 202, associated with the lubricant in the module 146.

The normal status indicator 212*b* (FIG. 2) identifies that the lubricant in the module 146 has not been changed since the last lubricant change or since the last time the lubricant changed indicator 212*a* was activated. In some embodiments, the normal status indicator 212*b* may identify the remaining useful life of the lubricant in the module 146. The remaining useful life calculation may be based at least in part on the detection, by the controller 204, of when the lubricant has been changed using the lubricant characteristic 402 of viscosity or density.

The lubricant changed indicator 212*a* identifies that the lubricant in the module 146 has been changed. In some embodiments, the lubricant changed indicator 212*a* may also identify the remaining useful life of the lubricant in the module 146. In some embodiments, the lubricant changed indicator 212*a* and the normal status indicator 212*b* may be differentiated by color, shape, labeling, text, illuminated light, flashing light, sound or the like on the user interface 202 or its display 210. A user interface 202 may display indicators 212 for each of multiple modules 146. For example, in one embodiment, the user interface 202 may display a lubricant changed indicator 212*a*, on the user interface 202, associated with the lubricant in the engine 112, and may also display a normal status indicator 212*b* associated with the lubricant in the transmission 130, and may also display a normal status indicator 212*b* associated with the lubricant in the implement hydraulic system 134.

In block 335, the user interface 202 displays the indicator 212 of the condition of the lubricant in the module 146 based on the signal generated by the controller 204 in block 330.

Also disclosed is a method 300 for activating on a user interface 202 an indicator 212 of a condition that is a measure of quality of a lubricant in a module 146 of a machine 100. The method 300 may comprise receiving, for a first time window 404 and a second time window 404, a plurality of lubricant characteristics 402 and measured lubricant temperatures of the lubricant in the module 146 (each of the plurality of lubricant characteristics being associated with a respective measured lubricant temperature of the measured lubricant temperatures); calculating an adjusted lubricant characteristic for each of the plurality of lubricant characteristics 402 based on the lubricant characteristic 402 (or filtered lubricant characteristic 402) and a relationship between a standard temperature and the respective measured lubricant temperature that is associated with the lubricant characteristic 402; and determining, for one or more types of the plurality of lubricant characteristics 402, a slope 406 in each of the first time window 404 and the second time window 404, the slope 406 being based on a plurality of adjusted lubricant characteristics of the same type. The method 300 may further include determining a change in the slope 424 from the first time window 404 to the second time window 404 of adjusted lubricant characteristics of the same type; generating, by a controller 204, a signal to activate the indicator 212 on a user interface 202 based on the change in slope; and displaying the indicator 212 of the condition of the lubricant in the module 146 on the user interface 202 based on the signal generated by the controller 204, wherein if the change in slope 424 for the plurality of adjusted lubricant characteristics exceeds a threshold 422, the indicator 212 is a lubricant changed indicator 212*a*.

Operators of machines 100 may find the features disclosed herein to be particularly beneficial because such features provide notification/confirmation of when lubricant has been changed based on the viscosity or density of the lubricant. The features disclosed herein help ensure that lubricant is not unnecessarily changed due to uncertainty that may occur when a maintenance technician forgets to reset a switch/flag after changing the lubricant on the machine 100. Further, the features herein ensure a more accurate display of remaining useful life (due to the reset of remaining useful life when a lubricant change has been detected) for the lubricant which helps an operator plan for when a change is likely to be needed.

No element/component, act/action performed by any element/component, or instruction used herein should be construed as critical or essential unless explicitly described as such. Additionally, the phrase "based on" is intended to mean "based, at least in part, on" unless explicitly stated otherwise. Furthermore, the articles "a" and "an," as used herein, are intended to include one or more items, and may be used interchangeably with "one or more." In the event only one item is intended, the term "one" or similar language is used. Moreover, the terms "has," "have," "having," or the like, as also used herein, are intended to be open-ended terms.

What is claimed is:

1. A system for activating on a user interface an indicator of a condition of a lubricant in a module of a machine, the system comprising:

a controller configured to:

for a first time window and a second time window:

receive a plurality of lubricant characteristics and measured lubricant temperatures of the lubricant in the module, each of the plurality of lubricant characteristics being associated with a respective measured lubricant temperature of the measured lubricant temperatures, calculate an adjusted lubricant characteristic for each of the plurality of lubricant characteristics based on the lubricant characteristic and a relationship between a standard temperature and the respective measured lubricant temperature that is associated with the lubricant characteristic, and determine, for one or more types of the plurality of lubricant characteristics received, a slope in each of the first time window and the second time window, the slope being based on a plurality of adjusted lubricant characteristics of the same type;

determine a change in the slope from the first time window to second time window of adjusted lubricant characteristics of the same type; and generate a signal to activate the indicator on the user interface based on the change in the slope; and a user interface configured to display the indicator based on the signal generated by the controller, wherein if the change in slope for the plurality of adjusted lubricant characteristics exceeds a threshold, the indicator is a lubricant changed indicator.

2. The system of claim 1, wherein the lubricant is oil and the module is an engine, a transmission or a hydraulic system.

3. The system of claim 1, wherein the adjusted lubricant characteristics are for density.

4. The system of claim 1, wherein the first time window and the second time window are rolling time windows.

5. The system of claim 1, wherein the adjusted lubricant characteristics are for viscosity.

6. The system of claim 1, in which the controller is further configured to filter the lubricant characteristics based on one or more current operating parameters of the module.

7. The system of claim 6, wherein the operating parameters include speed of or load on the module.

8. The system of claim 1, wherein the controller is further configured to reset a remaining useful life of the lubricant based on the change in slope.

9. The system of claim 1, wherein the change in slope for the plurality of adjusted lubricant characteristics is a downward spike that exceeds the threshold.

10. A method for activating on a user interface an indicator of a condition that is a measure of quality of a lubricant in a module of a machine, the method comprising:

receiving, for a first time window and a second time window, a plurality of lubricant characteristics and measured lubricant temperatures of the lubricant in the module, each of the plurality of lubricant characteristics being associated with a respective measured lubricant temperature of the measured lubricant temperatures;

calculating an adjusted lubricant characteristic for each of the plurality of lubricant characteristics based on the lubricant characteristic and a relationship between a standard temperature and the respective measured lubricant temperature that is associated with the lubricant characteristic;

determining, for one or more types of the plurality of lubricant characteristics received, a slope in each of the first time window and the second time window, the slope being based on a plurality of adjusted lubricant characteristics of the same type;

determining a change in the slope from the first time window to the second time window of adjusted lubricant characteristics of the same type;

generating, by a controller, a signal to activate the indicator on a user interface based on the change in slope; and displaying the indicator of the condition of the lubricant in the module on the user interface based on the signal generated by the controller, wherein if the change in slope for the plurality of adjusted lubricant characteristics exceeds a threshold, the indicator is a lubricant changed indicator.

11. The method of claim 10, wherein the module is an engine, a transmission or a hydraulic system.

12. The method of claim 10, wherein the lubricant is oil.

13. The method of claim 10, further comprising filtering the lubricant characteristic based on one or more current operating parameters of the module.

14. The method of claim 10, wherein the first time window and the second time window are rolling time windows.

15. A system for automatically detecting when a lubricant has been changed in a module of a machine and activating on a user interface an indicator of a condition of the lubricant in the module of the machine, the system comprising:

a controller configured to:

for each of a first time window and a second time window:

receive a plurality of lubricant characteristics, measured lubricant temperatures, and current operating parameters of the module, each of the plurality of lubricant characteristics being associated with a respective measured lubricant temperature of the measured lubricant temperatures and a respective current operating parameter of the current operating parameters of the module, (b) for each lubricant characteristic, if the measured lubricant temperature associated with the lubricant characteristic is in a desired temperature range and the current operating parameter associated with the lubricant characteristic is in a desired parameter range, calculate an adjusted lubricant characteristic based on the lubricant characteristic and a relationship between a standard temperature and the measured lubricant temperature associated with the lubricant characteristic, and determine, for one or more types of the plurality of lubricant characteristics received, a slope in each of the first time window and the second time window, the slope being based on a plurality of adjusted lubricant characteristics of the same type;

determine a change in the slope from the first time window to the second time window of adjusted lubricant characteristics of the same type; and generate a signal to activate the indicator on the user interface based on the change in slope; and a user interface configured to display the indicator of the condition of the lubricant in the module based on the signal generated by the controller, wherein if the lubricant characteristics received by the controller includes viscosities of the lubricant in the module, and if the change in slope from the first time window to the second time window for the plurality of adjusted lubricant characteristics for viscosity exceeds a viscosity threshold, the indicator is a lubricant changed indicator.

16. The system of claim 15, wherein the current operating parameter is operating speed of the module and the desired parameter range is a speed range.

17. The system of claim 15, wherein the current operating parameter is load on the module and the desired parameter range is a load range.

18. The system of claim 15, wherein each of the first time window and the second time window is a rolling time window.

19. The system of claim 15, in which the controller is further configured to determine that the lubricant has been changed in the module when the lubricant characteristics include densities of the lubricant in the module, and the change in slope for the plurality of adjusted lubricant characteristics of density exceeds a density threshold.

20. The system of claim 15, wherein the module is an engine, a transmission or a hydraulic system.

* * * * *